US008720935B2

(12) United States Patent
Holzer et al.

(10) Patent No.: US 8,720,935 B2
(45) Date of Patent: May 13, 2014

(54) SKI WITH A CONNECTING DEVICE FOR A SKI BINDING

(71) Applicant: Atomic Austria GmbH, Altenmarkt (AT)

(72) Inventors: Helmut Holzer, St. Johann (AT); Georg Klausner, St. Johann (AT); Josef Körner, Wagrain (AT)

(73) Assignee: Atomic Austria GmbH, Austria ( * ) Notice: Subject to any disclaimer, the term of this patent is extended or adjusted under 35 U.S.C. 154(b) by 0 days.

(21) Appl. No.: 13/826,716

(22) Filed: Mar. 14, 2013

(65) Prior Publication Data

US 2013/0249193 A1 Sep. 26, 2013

(30) Foreign Application Priority Data

Mar. 19, 2012 (AT) ..... A 334/2012

(51) Int. Cl.
*A63C 9/00* (2012.01)

(52) U.S. Cl.
USPC ..... 280/617

(58) Field of Classification Search
USPC ..... 280/11.14, 601, 602, 607, 609, 610, 280/611–617
See application file for complete search history.

(56) References Cited

U.S. PATENT DOCUMENTS

| | | | | |
|---|---|---|---|---|
| 3,797,844 | A | 3/1974 | Smolka et al. | |
| 5,046,751 | A * | 9/1991 | Scherubl | 280/607 |
| 5,129,668 | A * | 7/1992 | Hecht | 280/607 |
| 5,431,427 | A * | 7/1995 | Pieber et al. | 280/607 |
| 5,775,716 | A * | 7/1998 | Harsanyi et al. | 280/602 |
| 5,927,743 | A * | 7/1999 | Mantel | 280/602 |
| 6,270,108 | B1 * | 8/2001 | Phelipon et al. | 280/602 |
| 6,631,918 | B2 * | 10/2003 | Silva | 280/607 |
| 6,848,703 | B2 * | 2/2005 | Godde et al. | 280/607 |
| 7,300,069 | B2 * | 11/2007 | Schretter | 280/607 |
| D627,846 | S * | 11/2010 | Girard et al. | D21/773 |
| D650,461 | S * | 12/2011 | Svendsen et al. | D21/773 |
| 2001/0010420 | A1 * | 8/2001 | Arduin et al. | 280/611 |

FOREIGN PATENT DOCUMENTS

| | | | |
|---|---|---|---|
| CH | 681205 | A5 | 2/1993 |
| DE | 2134810 | A1 | 4/1972 |
| DE | 2135450 | A1 | 4/1972 |
| DE | 3602364 | A1 | 7/1987 |
| DE | 3932438 | A1 | 4/1990 |
| DE | 4321239 | A1 | 1/1994 |
| DE | 19517417 | A1 | 11/1996 |
| DE | 19654410 | A1 | 8/1997 |
| EP | 0780142 | A1 | 6/1997 |
| EP | 0780143 | A1 | 6/1997 |
| EP | 1051225 | A1 | 11/2000 |
| WO | 2008032349 | A1 | 3/2008 |

* cited by examiner

*Primary Examiner* — John Walters
*Assistant Examiner* — James Triggs
(74) *Attorney, Agent, or Firm* — Lerner, David, Littenberg, Krumholz & Mentlik, LLP

(57) ABSTRACT

A ski with a connecting device for connecting a ski binding to the ski. The connecting device includes a plate-type support body which has a fixing zone in its longitudinal middle portion for providing a rigid connection to the ski. At least the front end portion of the support body forms a flexural element extending freely with respect to the fixing zone and to the ski. The freely extending flexural element is made from plastic and is coupled with the ski via a coupling device. This coupling device comprises a connecting arm, which has a first articulated connection to the flexural element in its first end portion and a second articulated connection to the ski in its second end portion.

10 Claims, 3 Drawing Sheets

3
5
10
11
18
19
21
22
24
25
26
28
29
30
32
33
36
40

2
3
4
10
11
12
13
17
18
19
21
22
23
24
25
26
28
29
30
31
32
33
34
35
36
37
38
39

SKI WITH A CONNECTING DEVICE FOR A SKI BINDING

CROSS-REFERENCE TO RELATED APPLICATION

The present application claims priority from Austrian Patent Application No. A 334/2012, filed Mar. 19, 2012, the disclosure of which is hereby incorporated herein by reference.

BACKGROUND

The invention relates to a ski with a connecting device for connecting a ski binding comprising a front and rear cup piece to the ski.

An approach known from the prior art is to couple the two cup pieces of a ski binding, which comprises a toe piece and a heel piece spaced at a distance apart from the latter, with the ski body with a binding support plate or so-called binding plate connected in between. In this connection, there are essentially four known basic principles relating to the coupling of the binding support plate with the ski. In particular, the load-transmitting or force-transmitting coupling between the binding support plate and the ski body takes place starting from the central portion of the binding support plate or starting from the front and/or rear end of the binding support plate, as disclosed in DE 21 34 810 A1 and DE 21 35 450 A1, for example.

A known approach in particular is to support the oppositely lying distal ends or end portions of the binding support plate on the ski in a load-transmitting arrangement, thereby providing coupling mechanisms which affect the camber or bend of the ski body as little as possible in order to obtain a harmonious bending line and to impart as little stiffening as possible to the ski underneath the binding support plate in spite of having fitted the ski binding or binding support plate. Combinations of articulated connections or articulated and guide connections are provided for this purpose, which are disposed at the oppositely lying end portions of the binding support plate, as disclosed in publications U.S. Pat. No. 5,129,668 A, DE 39 32 438 A1, EP 1 051 225 A1, or CH 681 205 A5. Depending on the strength or bending stiffness of the binding support plate, elastomeric inserts may also be provided in the portions between the distal bearing or articulated connections to the ski, disposed between the binding support plate and the ski top face, thereby fulfilling a damping function and thus keeping any elastic flexing of the binding support plate, which is subjected to high stress, to a negligible degree.

In addition to the binding support plates mentioned above, with ski coupling mechanisms disposed at the ends, such as articulated joints and linear guides, for example, another known approach is to connect a binding support plate with a relatively high bending stiffness to the ski in an articulated arrangement at its middle or central portion and to connect at least one distal end, in particular the rear support plate end, to the ski via a coupling rod, causing a change in the inclination of the standing surface of the support body relative to the ski body, depending on the elastic camber or bend of the ski body, as disclosed by EP 0 780 142 B1. Based on another embodiment, the latter proposes coupling the rear half of the binding support plate rigidly with the ski and designing the front half of the binding support plate as a cantilevered flexural element, as disclosed in FIGS. 7, 8 of the above-mentioned publication. However, the performance which can be achieved with this construction is only satisfactory under certain conditions.

EP 0 780 143 B1 proposes connecting the front end of the binding support plate to the ski in a fixed arrangement remaining at the same height and mounting the rear end of the binding support plate so as to be adjustable in height relative to the ski top face. A rigid support element is provided in the longitudinal middle portion of the binding support plate, which guarantees a fixed minimum height between the binding support plate and the ski top face. This construction is intended to influence the stiffness of the ski under the effect of a compression force expended by the user.

WO 2008/032349 A1 specifies a binding support plate, which ensures a more uniform and more extensive pressure distribution of the ski body relative to the ground underneath. In this instance, a binding support plate with as high as possible a bending stiffness is provided, made from metal or a carbon fiber composite material (CFK). This rigid binding support plate is connected to the ski body at its middle portion by means of either an articulated connection or by means of a rigid connection. Respective extension arms are provided at oppositely lying ends of the support plate, which extend in the direction towards the ski tip and in the direction towards the ski end and each provide a coupling for the binding support plate and ski by means of an articulated connection as well as a combined rotating and translating connection. The extension arms projecting out towards the front and rear are intended to produce a more extensive distribution of force or pressure from the binding support plate towards the ski body. The disadvantage of this approach is that it is necessary to use a rigid support plate made from metal or CFK mounted at the center or middle of the ski body in order to withstand the forces which occur during use of the ski with sufficient positional stability. Especially in the event of elastic bending or flexing of the binding support plate supported on the center or middle of the ski body, performance is significantly impaired in terms of controllability and as regards the ability to maneuver the ski body as directly as possible and without delay.

BRIEF SUMMARY

The underlying objective of the invention is to propose a ski with a connecting device for the ski binding, whereby the ski body underneath the connecting device is able to undergo a deformation in a manner as uninhibited or freely elastic as possible, and whereby performance in terms of maneuverability or transmission of control forces by the user to the ski body with minimum delay is as effective as possible.

This objective of the invention is achieved by means of a ski with a connecting device. One advantage of the design proposed by the invention resides in the fact that a ski with as high a performance as possible is provided, especially in terms of maneuverability, which is also able to satisfy high demands with regard to economy and aesthetics. Amongst other things, the freely projecting flexural element made or molded from plastic can be integrated in the overall structure as harmoniously as possible in terms of its visual appearance. In addition, the co-operating connecting device can be manufactured relatively inexpensively because it can be mass produced with injection-molded parts, making it less costly to produce compared with metal components or CFK parts, which would require expensive machining and production processes. In particular, the specified construction can be produced on a particularly rational basis and in terms of cost and visual appearance is of interest to a wide circle of potential users. Another major advantage of the design proposed by the invention is the fact that as little stiffness as possible is imparted to the ski by the support body for the cup piece of the ski binding mounted centrally or at the middle, specifically ensuring a relatively free, harmonious bending characteristic curve of the ski body with respect to the connecting device secured to it. This relatively free and unhindered elastic bending or flexing of the ski body is therefore not detrimentally affected by the specified coupling device.

One particular advantage of this coupling device is the fact that it significantly increases the torsion resistance of the freely extending flexural element of the connecting device. In particular, the relatively high torsion resistance of the ski body in the region of the binding mounting zone is used as a means of significantly increasing the torsion resistance of the freely extending flexural element made from plastic. As a result, the control and torsional forces transmitted by the user to the freely extending flexural element are reliably absorbed without the occurrence of detrimental twisting of the flexural element about its longitudinal axis. Consequently, the most direct possible or delay-free and exact controllability of the ski is assured. Accordingly, since the coupling device prevents twisting of the plate-type support body as far as possible, thereby increasing torsion resistance, relative movements are still permitted between the freely extending flexural element and the ski body in the direction perpendicular to the ski top face and also in the ski longitudinal direction. Another advantage of this coupling device is that a precise mechanical coupling which remains free of wear for a long time is obtained due to the fact that one of the articulated connections of the connecting arm is disposed directly on a guide carriage. In addition, a guide carriage of this type is able to withstand relatively high torsional or twisting forces without giving rise to wear and tolerances over the long term.

Another particular advantage of the design proposed by the invention is the fact that the flexural element made from plastic is restricted with respect to lifting or spacing movements relative to the top face of the ski. In particular, the freely extending flexural element of the connecting device is limited by the restrictor element in terms of tendencies to move away from the ski top face. Accordingly, whilst the flexural element and ski body are able to approximate the standard use or flexing of the ski, a maximum travel distance between these components is limited. Also as a result, the freely extending flexural element reliably absorbs the relatively high distortion forces with respect to the flexural element which occur when the user falls forwards or backwards without the occurrence of circumstances or relative positions which might compromise the safety trigger values of a safety binding. Accordingly, in addition to satisfying the requirements of high performance, being highly economic and meeting high aesthetic requirement or design options, the specified device also meets high safety requirements in combination with ski bindings secured or supported on it.

Another advantage of an embodiment of the invention relates to the enhanced strength or bending resistance of the freely extending flexural element of the connecting device, whilst nevertheless enabling the most economic production possible. In particular, it is possible to set up automated and hence relatively inexpensive mass production and the resultant construction meets both high economic and performance-oriented requirements.

Another advantageous embodiment provides a multiple technical functionality of the bearing body is obtained, thereby reducing the number of parts and reducing the overall cost of producing a corresponding ski. Also as a result, the bearing body, which has an essentially C-shaped crosssection, forms a sort of cladding or spoiler element for the front longitudinal end of the support body, which cladding or spoiler element is able to cover or clad the mechanically and kinematically relevant components of the coupling device. This offers a simple way of meeting aesthetic requirements but also requirements in terms of the functional reliability and robustness of the coupling device.

Another advantage of an embodiment of the invention relates to a robust coupling device which functions as intended for a long period, which is also capable of withstanding high forces, in particular strong twisting or torsional forces during use of the ski without any problem.

Another advantage of an embodiment of the invention relates to the freely extending flexural element of the support body is supported in an elastically flexible manner, thereby enabling its bending resistance to be influenced in a specific way and increased to the desired degree. In spite of this, it is still possible for the ski body to effect the corresponding flexing or elastic deformation even in the region underneath the binding support plate with the least possible obstruction, thereby ensuring that a bending characteristic curve is obtained which is as harmonious as possible or extends uniformly, which is conducive to the performance which can be achieved with the ski.

Another advantage of an embodiment of the invention relates to a virtually selective seating or support surface, which on the one hand supports the freely extending flexural element relative to the ski top face, thereby counteracting any lowering thereof. On the other hand, an elastic deformation of the ski body in the portion underneath the freely extending flexural element is assisted or preserved with as little hindrance as possible.

Another advantage because of an embodiment of the invention relates to the performance which can be achieved with this ski is relatively high. In particular, better account is taken of performance-oriented aspects because the ski body is able to develop a relatively uniform and harmonious bending line. This enables optimum grip to be achieved on the ground underneath as well as readily controllable cornering behavior. This is possible, amongst other things, due to the fact that the rear end of the support body is retained so that it is able to slide freely relative to the ski in the ski longitudinal direction.

Another advantage of an embodiment of the invention relates to a high-strength but lightweight connection of the rear end portion of the support body to the ski is obtained. A coupling which slides freely in the ski longitudinal direction and is as free from tension as possible is obtained between these elements nevertheless.

Another advantage of an embodiment of the invention relates to the support body and freely extending flexural element of the connecting device fulfill a plurality of functions, thereby obviating the need for additional components and thus enabling manufacturing costs to be kept as low as possible. In addition, the overall weight of the corresponding design can be kept relatively low. In spite of this, the corresponding embodiment offers a ski binding which makes it easy to adapt individually to respective shoe sizes. Furthermore, at least one cup piece of the ski binding can be efficiently converted so that it is held in a manner enabling it to slide relative to the support body.

Another advantage of an embodiment of the invention relates to a dimensioning because it affords a specific damping or flexing function due to the connecting device and its support body. In particular, impacts which occur when travelling on the ski are transmitted to the user in damped form, thereby enabling comfort to be enhanced for the user.

BRIEF DESCRIPTION OF THE DRAWINGS

To provide a clearer understanding, the invention will be described in more detail below with reference to the appended drawings These are highly simplified, schematic diagrams illustrating the following.

DETAILED DESCRIPTION

Figure 1:
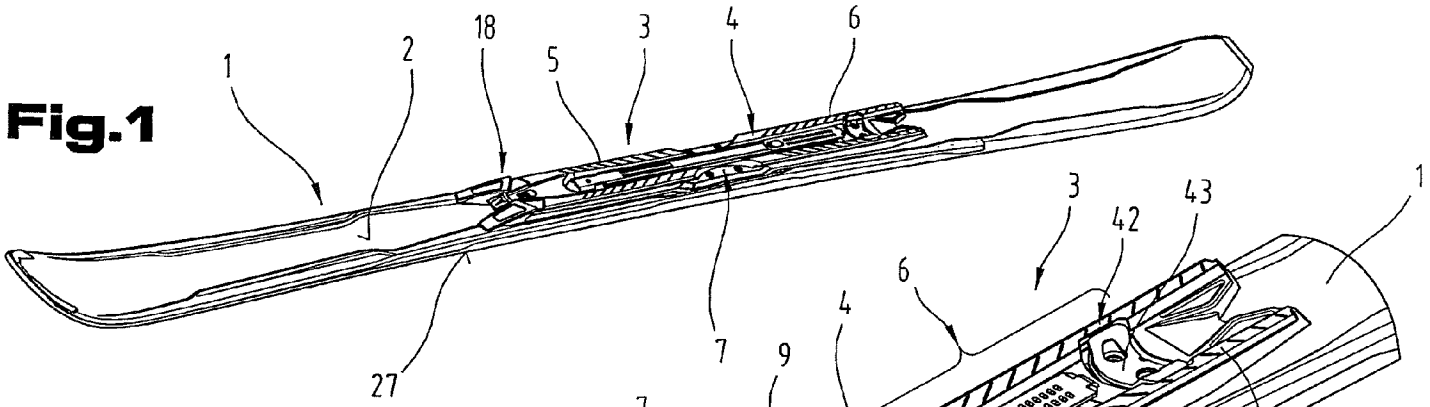
FIG. 1 is a perspective view from above illustrating a ski with a connecting device for a ski binding mounted on it.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Figure 2:
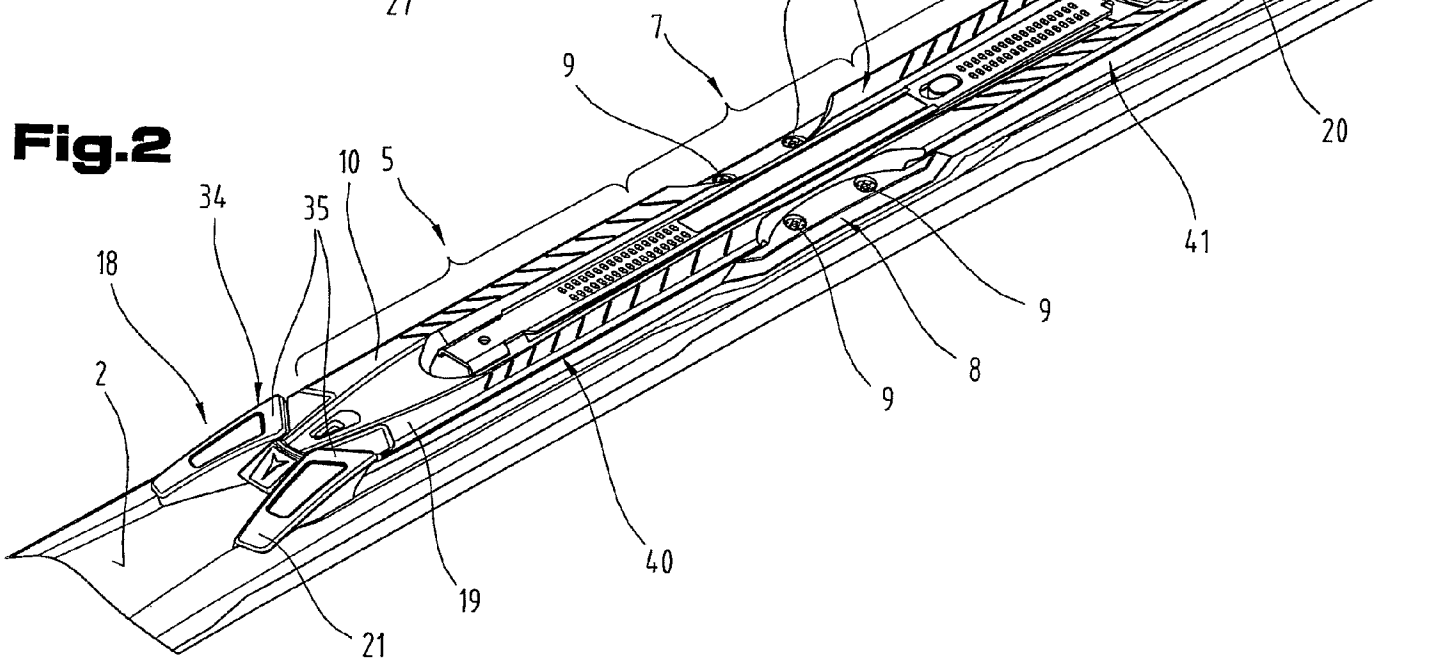
FIG. 2 shows the connecting device on the ski illustrated in FIG. 1 on a larger scale.

FIGS. 1, 2 illustrate an example of an embodiment of a ski 1 proposed by the invention, with a connecting device 3 disposed on its top face 2 for a ski binding, although the latter is not illustrated. Such a ski binding comprises a front cup piece, not illustrated, to provide a coupling with the toe portion of a sports shoe, which can be released as necessary, and a rear cup piece spaced at a distance apart from it to provide a coupling with the heel portion of a user's sports shoe, which can be released as necessary. In particular, any ski binding known from the prior art can be fitted on the connecting device 3, in particular slid on in a positively fitting arrangement, and secured in the desired relative position. This makes it possible to adapt to the individual shoe sizes of the respective user. This ski binding preferably fulfills the function of a so-called safety binding, which releases the user's sports shoe when predefined trigger values or force threshold values occur.

The connecting device 3 on the top face 2 of the ski 1 comprises an essentially plate-type or rail-type support body 4 for the two cup pieces of the ski binding. In particular, the support body 4 is designed at its front or ski tip end portion 5 to retain the front cup piece and at its rear end portion 6 to retain the rear cup piece. The plate-type support body 4 of the connecting device 3 has a length of between 40 and 70 cm, preferably approximately 55 cm. By contrast, the length of the ski 1 is a multiple of the length of the support body 4, typically between 140 cm and 190 cm.

The connecting device 3 between the ski binding and the ski 1 is provided in the form of a so-called binding plate, which is fitted centrally or in the middle. In other words, the support body 4 of the connecting device 3 has a fixing zone 8 in its longitudinal middle portion 7 for providing a rigid connection to the ski 1. By reference to the ski longitudinal direction, the fixing zone 8 has a longitudinal extension of up to 10 cm. In the embodiment illustrated as an example, the support body 4 is rigidly or fixedly screwed to the ski 1 by a plurality of fixing means 9, in particular screws. It is expedient to use a paired arrangement of at least two screws, for example four screws. This fixing zone 8 typically lies in the longitudinal middle of the support body 4 or connecting device 3, as may be seen in particular from FIG. 2. In this fixing zone 8, in the region of the longitudinal middle portion 7 of the support body 4, the most rigid possible coupling is provided between the support body 4 and the ski, in particular a screw connection, which is inflexible in all spatial directions.

Figures 3A, 3B:
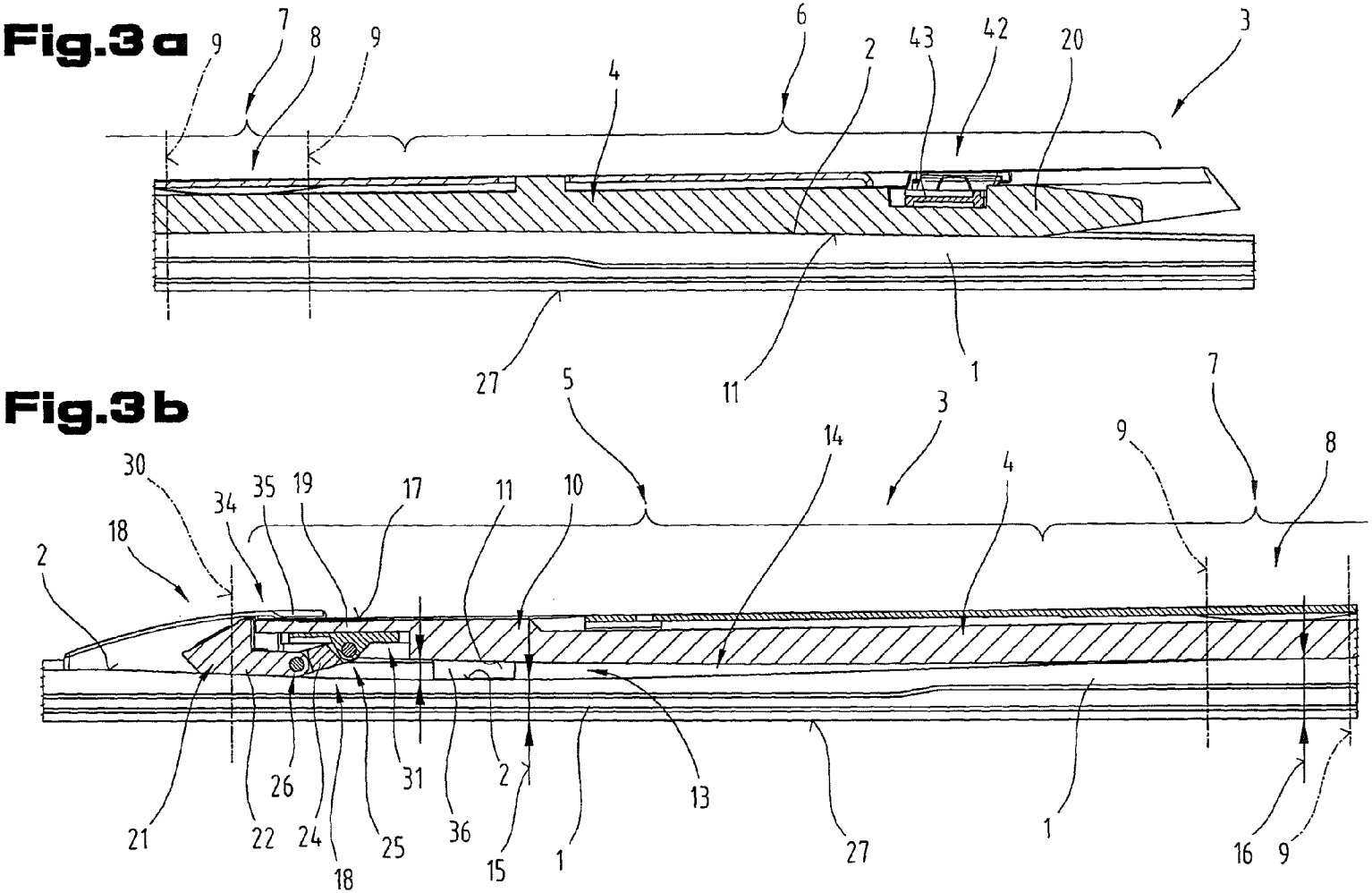
FIG. 3*a* shows the connecting device illustrated in FIG. 2 in its rear end portion, viewed in section in the ski longitudinal direction.
FIG. 3*b* shows the connecting device illustrated in FIG. 2 at its front end portion, viewed in section in the ski longitudinal direction.

At least the front end portion 5 of the support body 4 forms a flexural element 10 which extends freely relative to the central fixing zone 8 of the support body 4, as may best be seen from FIG. 3*b*. In particular, the support body 4 is of a freely supporting design, at least in the direction towards the front end portion 5, starting from its central fixing zone 8 where it lies directly on the top face 2 of the ski 1, in other words is spaced at a distance apart from the top face 2 of the ski 1. Based on the embodiment illustrated, only the front end portion 5 of the support body 4 is freely extending or statically self-supporting and is therefore not supported on the top face 2 of the ski 1, at least in its foremost end portion. The support body 4 therefore acts as a flexural element 10 clamped at one end, at least in its front part-portion, in particular at least in the front third of its longitudinal extension. The clamping or retaining action at one end is effected from the central or longitudinal middle fixing zone 8. The front, freely extending end portion 5 of the support body 4 may amount to between 20% and 50%, preferably between 30% and 40%, of the length of the support body 4.

Accordingly, the bottom face 11 of the support body 4 is positioned at a vertical distance 12 from the top face 2 of the ski 1, at least in the front end portion 5 of the support body 4. As a result of this distance 12, a gap-type space 13 is created between the bottom face 11 of the support body 4 and the top face 2 of the ski 1. This space 13 is preferably formed by a depression-type surface recess 14 formed in the ski top face. In other words, a thickness 15 of the ski 1 in its longitudinal portion with the biggest distance 12 from the bottom face of the support body 4 is somewhat slimmer than a thickness 16 of the ski 1 within the fixing zone 8 and in the region close to the fixing means 9. As a result, the vertical height of the space 13, in particular the distance 12, can be kept sufficiently large to permit a sufficient relative movement between the freely extending flexural element 10 and the ski top face. Also as a result, the support body 4 remains more or less constant in terms of its thickness contour in the longitudinal direction across wide portions and is therefore of a sufficiently stable design. Naturally, however, it would also be possible for the support body 4 to be tapered, continuously or in steps, at least in the direction towards its front lengthways end 19 with a view to creating a sufficient vertical distance 12 in the region of the front lengthways end 19, thereby permitting a relative displacement, in particular an approximation between the front end portion 5 and the ski top face dependent on load, in the region of the front lengthways end 19. Such an approximation occurs when the support body 4 is subjected to load or pressure is applied during use of the ski 1. These typical loads therefore result in an elastic deformation of the support body 4, in particular its front and/or rear end portion 5, 6 extending out from the central fixing zone 8.

At least the front end portion 5 of the support body 4 is preferably designed as a flexural element 10 extending freely with respect to the top face 2 of the ski 1, at least in some portions. Alternatively or in combination with this, however, it would also be possible for the rear end portion 6 of the support body 4 to be designed as a freely extending flexural element, in other words to be spaced at a distance apart from the top face 2 of the ski 1 within at least some portions, thereby creating a gap-type space, in particular a space for vertical movement between the rear end portion 6 and the ski top face.

Due to the distance 12, forces and loads which occur in the vertical direction towards the top face 17 of the front end portion 5 during use therefore cause the distance 12 to be reduced. In particular, the front end portion 5 constituting the freely extending flexural element 10 is able to flex elastically in the direction towards the ski top face, thereby absorbing or damping impact loads such as can occur in particular during use of the ski 1.

This resiliently elastic flexing and rebounding flexural element 10 of the support body 4 based on a freely extending design is made from plastic, in particular molded from plastic. As a result, a maximum displacement path of up to 10 mm, preferably approximately 5 mm, is possible between the bottom face 11 and the ski top face without the elasticity of the flexural element 10 being permanently impaired and the yield strength of the plastic being exceeded. Based on one expedient embodiment, the flexural element 10 or the major part of the rail-type or plate-type support body 4 is made from injection molded plastic reinforced with glass fiber. In the case of another practical embodiment, the support body 4, in particular the at least one freely extending flexural element 10 of the connecting device 3, is made from polyamide reinforced with glass fiber, in particular PA6 with a glass fiber proportion of up to 45%. It is of practical advantage to use injection molded PA6-GF30 or PA6-GF40 as the plastic for the support body 4, especially for the at least one freely extending flexural element 10, resulting in good strength but also elasticity of the support body 4 in the region of the freely extending flexural element 10. It is of practical advantage if the plastic used has an E-modulus of between 6,000 and 14,000 MPa, preferably approximately 10,000 MPa.

The elasticity or bending resistance of the freely extending flexural element 10 is expediently dimensioned so that under the effect of a force of between 200 N and 350 N on the front lengthways end 19 of the support body 4 or on the ski tip end of the front end portion 5, where the effect of the force is oriented perpendicular to its top face 17, a relative displacement of between 1 mm and 3 mm, in particular approximately 2 mm, occurs in the direction towards the ski top face. The elasticity or bending resistance of the freely extending flexural element 10 of the support body 4 based on one advantageous embodiment may also be dimensioned so that under the effect of a force of the type described above of between 500 N and 800 N, a relative displacement of between 3 mm and 5 mm, in particular approximately 4 mm, occurs in the direction towards the ski top face. The corresponding elasticity or bending resistance values can be achieved by the support body 4 and by its freely extending flexural element 10, preferably inclusive of the supporting effect, of an elastically flexible support body 36 that will be described below.

The connecting device 3 further comprises at least one mechanical coupling device 18 on at least one lengthways end, in particular on the front lengthways end 19, of the support body 4. This mechanical coupling device 18 is designed so that a load-induced change in the distance 12 between the freely extending flexural element 10 and the ski top face is possible or permitted but any twisting of the freely extending flexural element 10 about its longitudinal axis or about the ski longitudinal axis is prevented as far as possible. In particular, the coupling device 18 is used to inhibit or prevent elastic twisting movements of the freely extending flexural element 10 and the front end portion 5 of the support body 4 due to torsional forces acting on them. A coupling device 18 of this type is preferably provided on each freely extending end of the support body 4. In other words, if the rear end portion 6 of the support body 4 is also based on a freely extending design, the rear lengthways end 20 is likewise provided with such a coupling device. In the embodiment illustrated as an example, the rear end portion 6 of the support body 4 lies with its bottom face 11 on the ski top face essentially without a gap, so that there is no freely extending end portion, as may be seen from FIG. 3*a*. This being the case, a device for providing a mechanical coupling with the ski body is not provided in the rear end portion 6 of the support body 4 in the embodiment illustrated.

Figure 4:
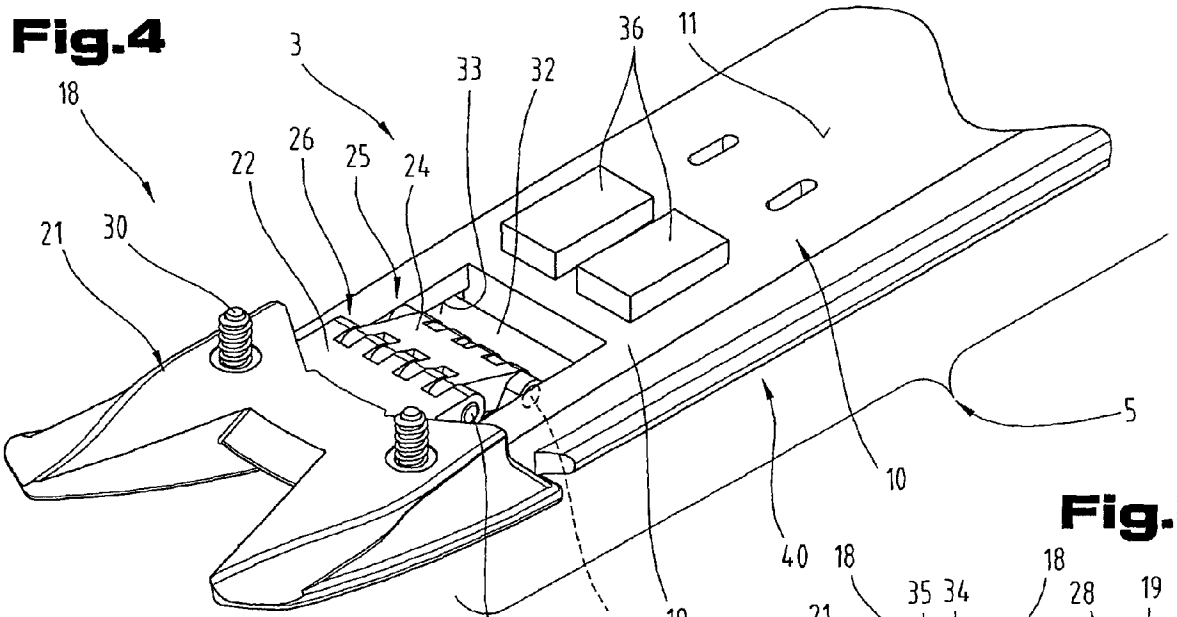
FIG. 4 is a perspective view onto the bottom face showing the front end portion of the connecting device.
Figure 5:
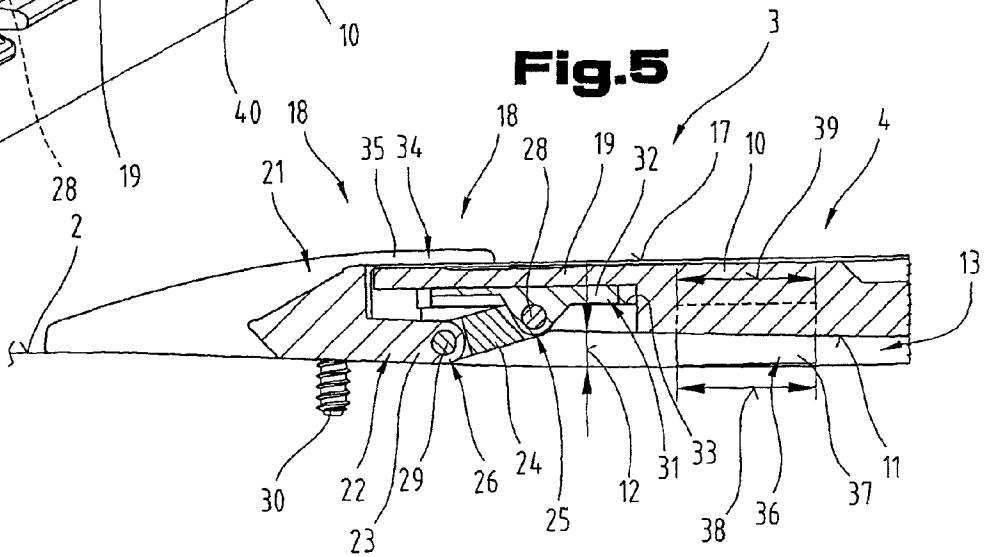
FIG. 5 shows a vertical longitudinal section through the front end portion of the connecting device illustrated in FIG. 4.

FIGS. 4, 5 illustrate the mechanical coupling device 18 provided on at least one lengthways end 19, 20 of the support body 4 on a larger scale.

This coupling device 18 comprises an essentially C-shaped bearing body 21 in terms of longitudinal section, in particular relative to a vertical section extending parallel with the ski longitudinal direction. A bottom arm 22 of this essentially C-shaped bearing body 21 thus constitutes a bearing point 23 for a mechanical connecting arm 24 to the support body 4, in particular to its front lengthways end 19. In particular, the coupling device 18 comprises a connecting arm 24, which has a first articulated connection 25 to the freely extending flexural element 10 in its first end portion and a second articulated connection 26 to the ski 1 in its second end portion. The two articulated connections 25, 26 therefore constitute pivot axes 28, 29 extending transversely to the ski longitudinal direction and essentially parallel with the running surface 27 of the ski 1—FIGS. 3*a, b*. These pivot axes 28, 29 are preferably provided in the form of bolt connections. Alternatively, however, it would also be possible to provide at least one articulated connection 25, 26 or at least one pivot axis 28, 29 by means of a so-called material hinge or film hinge, in particular a tapered region in the material in the transition region between the connecting arm 24 and bearing body 21 or between the connecting arm 24 and flexural element 10.

The bearing body 21 is rigidly connected to the ski 1, in particular by means of at least one screw-type fixing means 30, secured on the ski top face so that it is not able to slide. The arm 22 of the C-shaped bearing body 21 thus forms a part-component of the second articulated connection 26, as may best be seen from FIG. 5. The first or top articulated connection 25 of the connecting arm 24 is preferably disposed on a guide carriage 31, which is displaceable in a sliding or translating movement in the ski longitudinal direction. This guide carriage 31 is preferably disposed on the support body 4, in particular on its front lengthways end 19, as may be seen from FIGS. 4, 5. It is of practical advantage if this guide carriage 31 has a slide plate 32, which is guided in a sliding movement in a guide groove 33 on the freely extending flexural element 10 by reference to the ski longitudinal direction. This slide plate 32 of the guide carriage 31 is coupled with or articulatingly connected via the first articulated connection 25 to the connecting arm 24. As a result of this mechanical coupling comprising the connecting arm 24 with the two articulated connections 25, 26 and the guide carriage 31 displaceable in a sliding movement in the ski longitudinal direction, movements apart and towards one another are permitted between the flexural element 10 and the ski top face but any twisting movements or deviating sideways movements of the freely extending flexural elements 10 are inhibited or prevented. In this respect, it is of advantage to guide the slide plate 32 in the guide groove 33 so that the slide plate 32 is mounted without any clearance or with hardly any clearance transversely to the longitudinal axis of the support body 4.

Instead of the guide carriage 31 co-operating with the support body 4 or flexural element 10, it would also be possible for the bearing body 21 to effect a corresponding translating, longitudinal compensation, in particular for the guide carriage to be guided on the bearing body 21 and a rotating articulated connection 25 to be provided directly on the flexural element 10.

It is particularly expedient to provide at least one restrictor element 34, which suppresses, restricts or inhibits load-induced lifting tendencies or lifting movements of the flexural element 10 relative to the ski 1. In particular, at least one restrictor element 34 is provided, which causes the maximum distance 12 between the bottom face 11 of the flexural element 10 and the ski top face to be limited. From a functional point of view, this restrictor element 34 prevents a load-induced bending or spacing of the front lengthways end 19 across an essentially straight extension of the front end portion 5. Consequently, an arc-shaped bending or lifting of the freely extending flexural element 10 is suppressed, restricted or inhibited to a sufficient degree. Excessive strain or loads which risk breaking the freely extending flexural element 10 are prevented as a result. Furthermore, relative states which would inadmissibly alter the safety function of a safety binding disposed thereon are also suppressed or prevented. Amongst other things, this restrictor element 34 is important in connection with distorting forces which would occur on the front, freely extending flexural element 10 if the user were to fall backwards.

It is of particular advantage if the essentially C-shaped bearing body 21 on a vertical longitudinal section extending parallel with the ski longitudinal direction constitutes the at least one restrictor element 34 with its top arm 35. In particular, the arm 35 acts as a sort of stop element, which prevents, inhibits or limits to a predefined degree any lifting movement of the flexural element 10 relative to the ski top face, as may best be seen from the diagram illustrated in FIG. 5.

Based on one practical embodiment, the resiliently elastic, flexible, freely extending flexural element 10 is supported in a resiliently elastic, flexible arrangement. To this end, at least one elastically flexible support body 36 is provided between the top face 2 of the ski 1 and the bottom face 11 of the flexural element 10. This elastically flexible support body 36 supports the freely extending flexural element 10 in an elastically flexible manner relative to the ski top face. Based on one advantageous embodiment, the support body 36 is provided in the form of an elastomeric foam element 37. This support body 36 expends a supporting force or counter-force on the bottom face 11 of the flexural element 10, which counteracts increased resistance to a load-induced reduction in the distance 12.

Based on one advantageous design, the elastically flexible support body 36 has a seating length 38 by reference to the ski longitudinal direction of less than 5 cm with respect to the top face 2 of the ski 1 and/or a supporting length 39 by reference to the ski longitudinal direction of less than 5 cm with respect to the flexural element 10. As may best be seen from FIG. 4, it may be expedient to provide a pair of elastically flexible support bodies 36.

As may best be seen by comparing FIGS. 2 and 4, the front and/or rear end portion 5, 6 of the support body 4 may have an essentially top-hat rail or C-shaped cross-sectional contour. As a result, the front and/or the rear end portion 5, 6 of the support body 4 forms a longitudinal guide 40, 41 for the front and/or rear cup piece of a ski binding. In particular, the support body 4 can be used as a means of directly accommodating or providing a load-absorbing retaining system for the cup piece of a ski binding as a result. These longitudinal guides 40, 41 then offer a simple way of enabling an individual adjustment to be made to the distance between the cup pieces, i.e. adapt to the respective shoe size, and/or a simple way of making an individual change to the shoe standing center relative to the ski longitudinal direction.

As may best be seen from FIG. 3*a*, the rear end portion 6 of the support body 4 may be supported on the ski top face by its bottom face 11 on virtually the full surface or across the entire longitudinal extension. In the embodiment illustrated in FIG. 3*a*, the rear end portion 6 of the support body 4 does not therefore have a freely extending flexural element. Nevertheless, this rear end portion 6 is secured in such a way that relative movements between the rear end portion 6 and the ski 1 are permitted due to the bend or camber of the ski body. This so-called freely sliding retaining system is achieved by means of a coupling which permits relative sliding movements. In particular, the rear end portion 6 of the support body 4 is supported relative to the ski top face in a load-transmitting arrangement by means of a fixing device 42, but is retained so as to slide freely in the ski longitudinal direction and is secured by the fixing device 42 to prevent it from lifting off the ski top face. For practical purposes, a bracket-type, clamp-type or clip-type fixing element 43 is provided for this purpose, which extends round or extends through the support body 4 at its rear end portion 6 and is thus rigidly screwed to the ski 1. In particular, the fixing device 42 is designed so that relative movements between the fixing device 42 or between its fixing element 43 and the support body 4 are permitted in the ski longitudinal direction if the ski body is subjected to flexing or bending. On the other hand, the fixing device 42 prevents relative movements between the support body 4 or its rear end portion 6 and the ski 1 in all directions transversely to the ski longitudinal axis.

The stiffness of the support body 4 made from plastic is in any event dimensioned so that the support body 4 has a significantly lower bending resistance in terms of camber than the ski 1 within its longitudinal portion overlapping the support body 4. In other words, the ski 1 per se within the binding mounting zone affords significantly higher resistance to elastic flexing than the support body 4 per se in the binding mounting region disposed or secured on the ski top face.

The embodiments illustrated as examples represent possible variants of the ski 1 and the connecting device 3, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the ski 1 and the connecting device 3, they and their constituent parts are illustrated to a certain extent out of scale and/or on a larger scale and/or on a smaller scale.

The independent inventive solutions to the underlying objective may be found in the description.

Above all, the individual embodiments illustrated in FIGS. 1-5 constitute independent solutions proposed by the invention in their own right. The objectives and associated solutions proposed by the invention may be found in the detailed descriptions of these drawings.

LIST OF REFERENCE NUMBERS

1 Ski
2 Top face
3 Connecting device
4 Support body
5 End portion
6 End portion
7 Longitudinal middle portion
8 Fixing zone
9 Fixing means
10 Flexural element
11 Bottom face
12 Distance
13 Space
14 Surface recess
15 Thickness
16 Thickness
17 Top face
18 Coupling device
19 Lengthways end
20 Lengthways end
21 Bearing body
22 Arm
23 Bearing point
24 Connecting arm
25 Articulated connection
26 Articulated connection
27 Running surface
28 Pivot axis
29 Pivot axis
30 Fixing means
31 Guide carriage
32 Slide plate
33 Guide groove
34 Restrictor element
35 Arm
36 Support body
37 Foam element
38 Seating length
39 Supporting length
40 Longitudinal guide
41 Longitudinal guide
42 Fixing device
43 Fixing element

The invention claimed is:

1. A ski with a connecting device for connecting a ski binding comprising a front and rear cup piece to the ski, comprising a plate-type support body for the front and rear cup pieces, which support body is designed at its front end portion to retain the front cup piece and at its rear end portion to retain the rear cup piece, and the support body has a fixing zone in its longitudinal middle portion for rigidly connecting to the ski, and at least the front end portion of the support body constitutes a flexural element extending freely with respect to the fixing zone and to the ski, the lengthways end of which facing away from the fixing zone is connected to the ski by means of at least one mechanical coupling device so as to be relatively displaceable, wherein the freely extending flexural element is made from plastic, and the coupling device comprises a connecting arm which has a first articulated connection to the flexural element in its first end portion and a second articulated connection to the ski in its second end portion, and the first or second articulated connection is disposed on a guide carriage displaceable in a sliding movement in the ski longitudinal direction, and a restrictor element is provided for suppressing, restricting or inhibiting lifting movements of the flexural element relative to the ski.

2. The ski according to claim 1, wherein at least the freely extending flexural element of the support body is made from injection molded plastic reinforced with glass fiber.

3. The ski according to claim 1, wherein the coupling device comprises an essentially C-shaped bearing body by reference to a vertical longitudinal section extending parallel with the ski longitudinal direction, the bottom arm of which has a bearing point for the connecting arm and the top arm of which forms the restrictor element.

4. The ski according to claim 1, wherein the guide carriage comprises a slide plate which is guided in a sliding movement in a guide groove on the flexural element in the ski longitudinal direction and which is coupled with the connecting arm via the first articulated connection.

5. The ski according to claim 1, wherein the flexural element is supported by means of a support body which is elastically flexible relative to the ski, disposed between the top face of the ski and the bottom face of the flexural element.

6. The ski according to claim 5, wherein the elastically flexible support body has a seating length by reference to the ski longitudinal direction of less than 5 cm with respect to the top face of the ski and/or a supporting length by reference to the ski longitudinal direction of less than 5 cm with respect to the flexural element.

7. The ski according to claim 1, wherein the rear end portion of the support body is supported on the ski top face in a load-transmitting arrangement by means of a fixing device, being retained so as to slide freely in the ski longitudinal direction and secured to prevent any lifting from the ski top face.

8. The ski according to claim 7, wherein the fixing device comprises a clamp-type or clip-type fixing element which extends round or extends through the support body in its rear end portion and is rigidly screwed to the ski.

9. The ski according to claim 1, wherein the front and/or the rear end portion of the support body has an essentially top-hat rail or C-shaped cross-sectional contour, which forms a longitudinal guide for the front and/or rear cup piece.

10. The ski according to claim 1, wherein the support body has a lesser stiffness with respect to flexing than the ski within its longitudinal portion overlapping the support body.

* * * * *